US009549625B1

(12) United States Patent
Wilkinson et al.

(10) Patent No.: US 9,549,625 B1
(45) Date of Patent: Jan. 24, 2017

(54) BEDDING SYSTEMS AND METHODS

(71) Applicant: Wilkinson & Co Home LC, Salt Lake City, UT (US)

(72) Inventors: Jay B. Wilkinson, Salt Lake City, UT (US); Marius V. Gedgaudas, Sun Valley, CA (US)

(73) Assignee: WILKINSON & CO HOME LC, Salt Lake City, UT (US)

( * ) Notice: Subject to any disclaimer, the term of this patent is extended or adjusted under 35 U.S.C. 154(b) by 47 days.

(21) Appl. No.: 14/512,366

(22) Filed: Oct. 10, 2014

Related U.S. Application Data

(60) Provisional application No. 61/889,518, filed on Oct. 10, 2013.

(51) Int. Cl.

| | |
|---|---|
| ***A47G 9/02*** | (2006.01) |
| ***A47G 9/04*** | (2006.01) |
| ***A47G 9/10*** | (2006.01) |

(52) U.S. Cl.
CPC ..... *A47G 9/04* (2013.01); *A47G 9/0223* (2013.01); *A47G 9/0246* (2013.01); *A47G 9/0253* (2013.01); *A47G 9/10* (2013.01)

(58) Field of Classification Search
CPC ..... A47G 9/04; A47G 9/0223; A47G 9/10; A47G 9/0246; A47G 9/0253; A47G 9/02; A47C 21/02
See application file for complete search history.

(56) References Cited

U.S. PATENT DOCUMENTS

| | | | | | |
|---|---|---|---|---|---|
| 823,930 | A * | 6/1906 | Coakley | A47G 9/0253 | 5/490 |
| 2,630,588 | A * | 3/1953 | Levin | A47C 31/105 | 5/496 |
| 2,857,643 | A * | 10/1958 | Tomsic | A47G 9/0246 | 24/301 |
| 4,937,904 | A * | 7/1990 | Ross | A47C 21/022 | 24/72.5 |
| 5,208,927 | A | 5/1993 | Lachmar | | |
| 5,377,391 | A * | 1/1995 | Foster | A47C 21/022 | 24/301 |
| 5,442,822 | A | 8/1995 | Diaz | | |
| 5,878,455 | A | 3/1999 | Patterson | | |

(Continued)

FOREIGN PATENT DOCUMENTS

| | | |
|---|---|---|
| EP | 1132029 | 1/2002 |
| EP | 0787451 | 6/2003 |

(Continued)

OTHER PUBLICATIONS

European Search Report, European Patent App. No. EP 01105943, Dispatched on Nov. 30, 2001.

(Continued)

*Primary Examiner* — Robert G Santos
*Assistant Examiner* — Myles Throop
(74) *Attorney, Agent, or Firm* — Austin Rapp & Hardman

(57) ABSTRACT

A bedding system may be installable on a mattress. The bedding system may have a bottom sheet, a top sheet, and a duvet. The bottom sheet may have a peripheral portion with bottom sheet mounting elements that secure the bottom sheet to the mattress, and top sheet fastening elements. The top sheet may have top sheet mounting elements that secure the top sheet to the bottom sheet.

13 Claims, 6 Drawing Sheets

(56) References Cited

U.S. PATENT DOCUMENTS

| | | | | |
|---|---|---|---|---|
| 6,233,764 | B1 | 5/2001 | Orr | |
| 6,381,778 | B1 | 5/2002 | Peterson | |
| 6,389,621 | B1 | 5/2002 | Elliott et al. | |
| 6,457,194 | B1 | 10/2002 | Bennett | |
| 6,532,608 | B2 | 3/2003 | Schreiner | |
| 6,651,278 | B2 | 11/2003 | Ghanem | |
| 7,240,383 | B2 | 7/2007 | Stewart | |
| 7,293,306 | B2 | 11/2007 | Hermanczuk | |
| 7,380,297 | B2 | 6/2008 | Bauer | |
| D602,300 | S | 10/2009 | Jeska et al. | |
| 7,669,257 | B2 * | 3/2010 | Swihart | A47G 9/02 5/496 |
| 7,761,940 | B2 | 7/2010 | Hipp | |
| 7,810,184 | B2 | 10/2010 | McCollum | |
| 7,856,684 | B2 | 12/2010 | Robertson et al. | |
| 8,015,636 | B2 | 9/2011 | Bolish et al. | |
| 8,122,541 | B1 | 2/2012 | Georgatos | |
| 8,151,386 | B2 | 4/2012 | McKee | |
| 8,171,581 | B2 | 5/2012 | Agarwall | |
| 8,302,224 | B2 | 11/2012 | Lehmann | |
| 8,336,137 | B2 | 12/2012 | Aprile et al. | |
| 8,370,974 | B2 | 2/2013 | Caines | |
| 8,393,025 | B2 | 3/2013 | Crispino et al. | |
| 8,856,984 | B1 * | 10/2014 | Donham | A47G 9/0246 5/496 |
| 2002/0116763 | A1 * | 8/2002 | Weir | A47G 9/0246 5/504.1 |
| 2009/0106901 | A1 * | 4/2009 | Wootten, Jr. | A47G 9/0246 5/497 |
| 2009/0241261 | A1 | 10/2009 | Sack | |
| 2011/0283453 | A1 * | 11/2011 | Low | A47G 9/0261 5/501 |
| 2012/0260424 | A1 | 10/2012 | Agarwall | |
| 2012/0324647 | A1 | 12/2012 | McKee | |
| 2013/0097779 | A1 | 4/2013 | Caines | |
| 2013/0117933 | A1 * | 5/2013 | Mickle | A47G 9/02 5/413 R |
| 2014/0013510 | A1 * | 1/2014 | Mcaleney | A47G 9/0246 5/496 |
| 2015/0026887 | A1 * | 1/2015 | Taylor | A47G 9/0246 5/496 |

FOREIGN PATENT DOCUMENTS

| | | |
|---|---|---|
| WO | 9513730 | 5/1995 |
| WO | 2008141354 | 11/2008 |
| WO | 2012001530 | 3/2012 |

OTHER PUBLICATIONS

Annex to the European Search Report, European Patent App. No. EP 01105943, Dispatched on Nov. 30, 2001.

International Search Report, International Patent App. No. PCT/NZ 94/00132, Mailed on Mar. 9, 1995.

International Search Report, International Patent App. No. PCT/AU2007/001037, Mailed on Aug. 27, 2007.

* cited by examiner

BEDDING SYSTEMS AND METHODS

RELATED APPLICATIONS

This application claims priority to and is a non-provisional application of U.S. Provisional Patent App. No. 61/889,518, which is entitled ENGINEERED SHEET, TOP SHEET BUTTONING SYSTEM AND DOWN JACKET and was filed on Oct. 10, 2013. The foregoing application is incorporated herein by this reference in its entirety.

TECHNICAL FIELD

The present invention relates generally to sheets and covers for bedding. More specifically, the present invention relates to sheets with fastening systems for attaching them to beds and/or other bedding components.

BACKGROUND

Known bedding systems have a number of drawbacks. Fitted sheets with elastic corners are notoriously difficult to fold and difficult to properly orient with the mattress, and in many cases, require two people for effective installation on the mattress. Existing sheets and blankets are easily pulled askew on a mattress. Once this occurs, the bed must be remade. Additionally, aligning sheets and covers can also be challenging, and may require the efforts of two people. Accordingly, it would be an advantage in the art to provide improved bedding systems.

SUMMARY

Embodiments of the disclosed subject matter are provided below only for illustrative purposes and are in no way limiting of the claimed subject matter.

In one embodiment, a bedding system may have an uninstalled configuration and an installed configuration relative to a mattress. The mattress may have a top side, a bottom side, and a periphery. The bedding system may include a bottom sheet with a bottom sheet central portion and a bottom sheet peripheral portion extending from the bottom sheet central portion. The bottom sheet peripheral portion may have a plurality of bottom sheet mounting elements and a plurality of bottom sheet fastening elements. The bedding system may also include a top sheet with a top sheet central portion and a top sheet peripheral portion extending from the top sheet central portion. The top sheet peripheral portion may have a plurality of top sheet mounting elements. The bedding system may further include a duvet including a thermal layer, a bottom cover, and a top cover. The bottom cover may have a plurality of bottom cover mounting elements and a plurality of bottom cover fastening elements. The top cover may have a plurality of top cover fastening elements, each of which is securable to one of the bottom cover fastening elements to capture the thermal layer between the bottom cover and the top cover. In the installed configuration, the bottom sheet central portion may cover the top side of the mattress, the bottom sheet peripheral portion may cover the periphery of the mattress, the bottom sheet mounting elements may secure the bottom sheet to the mattress, each of the top sheet mounting elements may be secured to one of the bottom sheet fastening elements to secure the top sheet peripheral portion to the bottom sheet peripheral portion, and the bottom cover mounting elements may be secured to the top sheet. In one embodiment of the uninstalled configuration, the bottom sheet is not secured to the mattress, the top sheet is not secured to the bottom sheet, and the bottom cover is not secured to the top sheet.

The mattress may have four corners. The plurality of bottom sheet mounting elements may include four bottom sheet mounting elements. The bottom sheet peripheral portion may have four flexible connectors, each of which is coupled to one edge of the peripheral portion. Each of the flexible connectors may have two ends, each of which has a loop. Each of the bottom sheet mounting elements may include a first coupling that, in the installed configuration, extends underneath the corresponding corner to attach the loops of the corresponding two adjacent ends of the flexible connectors together.

The four corners may include two foot corners. The plurality of bottom sheet fastening elements may include two bottom sheet fastening elements, each of which includes a second coupling, a fifth flexible connector, and a sixth flexible connector. Each of the fifth flexible connectors and each of the sixth flexible connectors may have a loop. The plurality of top sheet mounting elements may include two top sheet mounting elements, each of which includes a first slot and a second slot. In the installed configuration, each of the two bottom sheet fastening elements may be positioned proximate one of the two foot corners, each of the two top sheet mounting elements may be positioned proximate one of the two foot corners, the loop of each fifth flexible connector may be inserted through the corresponding first slot, the loop of each sixth flexible connector may be inserted through the corresponding second slot. Each second coupling may be attached to the loops of the corresponding fifth and sixth flexible connectors.

In one embodiment, a bedding system may have an uninstalled configuration and an installed configuration relative to a mattress. The mattress may have a top side, a bottom side, and a periphery. The bedding system may include a bottom sheet with a bottom sheet central portion and a bottom sheet peripheral portion extending from the bottom sheet central portion. The bottom sheet peripheral portion may have a plurality of bottom sheet mounting elements and a plurality of bottom sheet fastening elements. The bedding system may also include a top sheet with a top sheet central portion and a top sheet peripheral portion extending from the top sheet central portion. The top sheet peripheral portion may have a plurality of top sheet mounting elements. In the installed configuration, the bottom sheet central portion may cover the top side of the mattress, the bottom sheet peripheral portion may cover the periphery of the mattress, the bottom sheet mounting elements may secure the bottom sheet to the mattress, and each of the top sheet mounting elements may be secured to one of the bottom sheet fastening elements to secure the top sheet peripheral portion to the bottom sheet peripheral portion. In one embodiment of the uninstalled configuration, the bottom sheet is not secured to the mattress, the top sheet is not secured to the bottom sheet, and the bottom sheet mounting elements does not exert elastic force tending to bunch or gather the bottom sheet peripheral portion.

The mattress may have four corners. The plurality of bottom sheet mounting elements may include four bottom sheet mounting elements. In the installed configuration, each of the bottom sheet mounting elements may extend underneath one of the corners to secure the bottom sheet to the mattress.

The bottom sheet peripheral portion may have four flexible connectors, each of which is coupled to one edge of the peripheral portion. Each of the flexible connectors may have two ends. Each of the bottom sheet mounting elements may include two adjacent ends of the flexible connectors.

Each of the bottom sheet mounting elements may further include a coupling. In the installed configuration, each coupling may extend underneath the corresponding corner to attach the corresponding two adjacent ends of the flexible connectors together.

Each of the ends of the flexible connectors may include a loop. Each of the couplings may include two anchors and a linking member. Each of the anchors may be securable to a corresponding one of the loops of the flexible connectors. The linking member may be secured to the anchors to apply tension tending to draw the two anchors together.

In one embodiment, the mattress may have two foot corners. The plurality of bottom sheet fastening elements may include two bottom sheet fastening elements and the plurality of Lop sheet mounting elements may include two top sheet mounting elements. In the installed configuration, each of the two bottom sheet fastening elements may be positioned proximate one of the two foot corners and each of the two top sheet mounting elements may be positioned proximate one of the two foot corners.

Each of the top sheet mounting elements may include a first slot. In the installed configuration, each first slot may receive the corresponding bottom sheet fastening element to secure the top sheet mounting element to the bottom sheet fastening element.

Each of the top sheet mounting elements may further include a second slot. Each of the bottom sheet fastening elements may further include a first flexible connector insertable through the first slot and a second flexible connector insertable through the second slot. In the installed configuration, the first and second flexible connectors of each of the bottom sheet fastening elements may be attached to each other.

Each of the first and second flexible connectors may have a loop. Each of the bottom sheet fastening elements may further include a coupling. In the installed configuration, each coupling may attach the loops of the corresponding first and second flexible connectors together. Each of the couplings may include two anchors, each of which is securable to a corresponding one of the loops of the flexible connector, and a linking member secured to the anchors to apply tension tending to draw the two anchors together.

The bedding system may further include a duvet including a thermal layer, a bottom cover, and a top cover. The bottom cover may include a plurality of bottom cover mounting elements and a plurality of bottom cover fastening elements. The top cover may include a plurality of top cover fastening elements, each of which is securable to one of the bottom cover fastening elements to capture the thermal layer between the bottom cover and the top cover. In the installed configuration, the bottom cover mounting elements may be secured to the top sheet. In one embodiment of the uninstalled configuration, the bottom cover mounting elements is not secured to the top sheet.

The bedding system may further include a pillow, which may comprise a cushion and an envelope. The envelope may include a sleeve that defines a pocket shaped to receive the cushion. The sleeve may have a plurality of sleeve fastening elements. The envelope may further include a flap extending from the sleeve. The flap may have a plurality of flap fastening elements, each of which is securable to one of the sleeve fastening elements to capture the cushion within the pocket.

According to one embodiment, a method may be used for installing a bedding system on a mattress. The mattress may have a top side, a bottom side, and a periphery. The method may include positioning a bottom sheet on the mattress. The bottom sheet may have a bottom sheet central portion and a bottom sheet peripheral portion extending from the bottom sheet central portion. The bottom sheet peripheral portion may have a plurality of bottom sheet mounting elements and a plurality of bottom sheet fastening elements. The method may further include positioning the bottom sheet such that the bottom sheet central portion covers the top side of the mattress and the bottom sheet peripheral portion covers the periphery of the mattress, and securing the bottom sheet to the mattress with the bottom sheet mounting elements to secure the bottom sheet peripheral portion to the periphery. The method may further include positioning a top sheet on the bottom sheet. The top sheet may have a top sheet central portion and a top sheet peripheral portion extending from the top sheet central portion. The top sheet peripheral portion may have a plurality of top sheet mounting elements. The method may further include positioning the top sheet such that the top sheet central portion covers the bottom sheet central portion, and securing each of the top sheet mounting elements to one of the bottom sheet fastening elements to secure the top sheet peripheral portion to the bottom sheet peripheral portion.

The mattress, in one embodiment, may have four corners. The plurality of bottom sheet mounting elements may include four bottom sheet mounting elements. The bottom sheet peripheral portion may include four flexible connectors, each of which is coupled to one edge of the peripheral portion. Each of the flexible connectors may have two ends. Each of the bottom sheet mounting elements may include a coupling and two adjacent ends of the flexible connectors. Securing the bottom sheet to the mattress may include positioning each coupling to extend underneath one of the corners, and attaching the corresponding two adjacent ends of the flexible connectors together with the coupling.

Each of the ends of the flexible connectors may have a loop. Each of the couplings may include two anchors and a linking member secured to the anchors. Attaching the corresponding two adjacent ends of the flexible connectors together with the coupling may include securing each of the anchors to one of the loops of the flexible connectors. Securing the bottom sheet to the mattress may further include, with the linking member, applying tension tending to draw the two anchors together.

The mattress may have two foot corners. The plurality of bottom sheet fastening elements may include two bottom sheet fastening elements, each of which includes a first flexible connector and a second flexible connector. Each of the first flexible connectors and each of the second flexible connectors may have a loop. The plurality of top sheet mounting elements may include two top sheet mounting elements, each of which has a first slot and a second slot. Positioning the top sheet such that the top sheet central portion covers the bottom sheet central portion may include positioning each of the two bottom sheet fastening elements proximate one of the two foot corners, and positioning each of the two top sheet mounting elements proximate one of the two foot corners. Securing each of the top sheet mounting elements to one of the bottom sheet fastening elements may include inserting the loop of each first flexible connector through one of the first slots, inserting the loop of each second flexible connector through one of the second slots, and attaching the loop of each first flexible connector to the loop of the corresponding second flexible connector.

Attaching the loop of each first flexible connector to the loop of the corresponding second flexible connector may include securing a first anchor of a coupling to the loop of each first flexible connector to the loop of the corresponding second connector. With a linking member secured to each first anchor and each second anchor, tension may be applied, which may tend to draw the corresponding first and second anchors together.

The method may further include securing a duvet to the top sheet. The duvet may include a thermal layer, a bottom cover with a plurality of bottom cover mounting elements, and a top cover securable to the bottom cover to capture the thermal layer between the bottom cover and the top cover. Securing the duvet to the top sheet may include securing the bottom cover mounting elements to the top sheet.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

Figure 1:
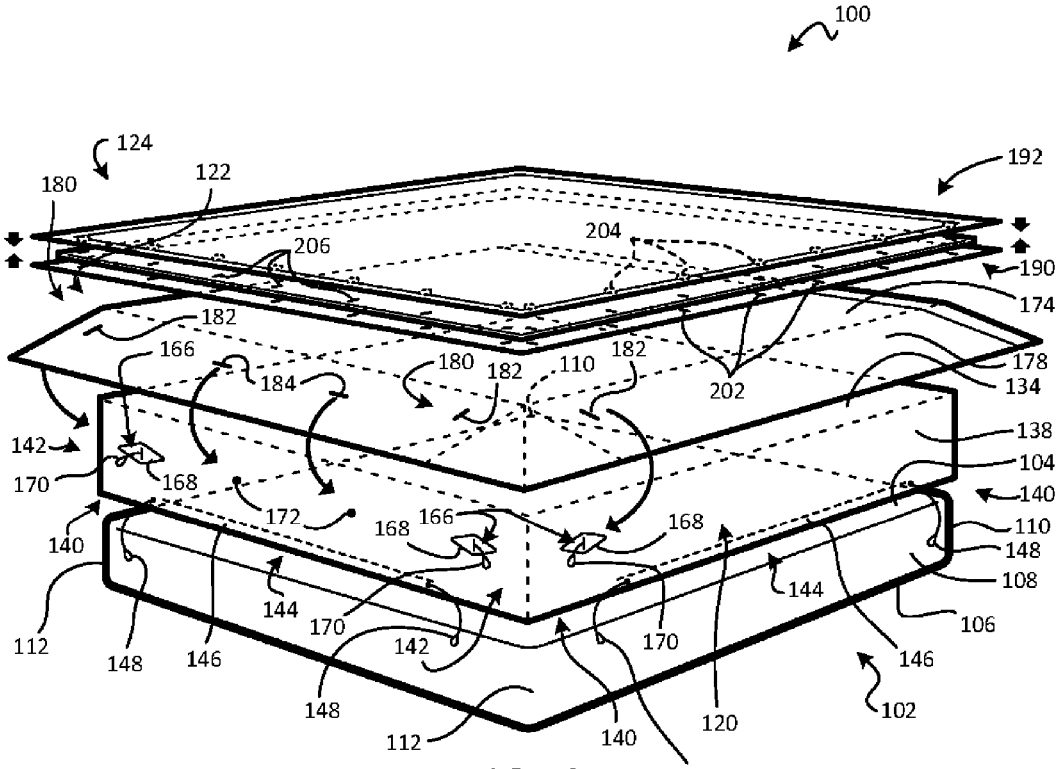
FIG. 1 is a perspective view illustrating a bedding system according to one embodiment.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus (e.g., device) or method. Finally, like reference numerals may be used to denote like features throughout the specification and figures.

DETAILED DESCRIPTION

Various aspects of the disclosure are described below. It should be apparent that the teachings herein may be embodied in a wide variety of forms and that any specific structure, function, or both being disclosed herein is merely representative. Based on the teachings herein, one skilled in the art should appreciate that an aspect disclosed herein may be implemented independently of any other aspects and that two or more of these aspects may be combined in various ways even if not shown or disclosed in the same figure or portion of the disclosure. Further, the disclosed apparatuses and methods may be practiced using structures or functionality in addition to disclosed subject matter based on information known to one of skill in the art.

In the figures, certain components may appear many times within a particular drawing. However, only certain instances of the component may be identified in the figures to avoid unnecessary repetition of reference numbers and lead lines. According to the context provided in the description while referring to the figures, reference may be made to a specific one of that particular component or multiple instances, even if the specifically referenced instance or instances of the component are not identified by a reference number and lead line in the figures.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

FIG. 1 is a perspective view illustrating a bedding system 100 according to one embodiment. The bedding system 100 may be used in conjunction with a mattress 102, and may provide expedited and/or facilitated installation on the mattress 102. Additionally or alternatively, the bedding system 100 may facilitate and/or expedite the efforts of a user to make a bed in which the bedding system 100 and the mattress 102 are incorporated.

The mattress 102 may be of any type known in the art. Advantageously, the mattress 102 need not possess any unique features to facilitate installation of the bedding system 100. Rather, the bedding system 100 may be made for use with a mattress with a standard size and shape. For example, the mattress 102 may be a kings-size mattress, but in alternative embodiments, the bedding system 100 may be adapted to fit a twin, double, full, queen, king, California king, or any other known mattress size.

As shown, the mattress 102 may have a top side 104, a bottom side 106, and a periphery 108. The top side 104 may have a generally planar shape, and the bottom side 106 may also have a generally planar shape parallel to that of the top side 104. The periphery 108 may be perpendicular to the top side 104 and the bottom side 106, and may connect the top side 104 to the periphery 108.

Further, the mattress 102 may have a generally rectangular shape, with four corners. The four corners may include two head corners 110 and two foot corners 112. In a bed frame (not shown), the head corners 110 may be positioned toward the head and/or headboard of the frame, and the foot corners 112 may be positioned toward the foot and/or footboard of the frame.

The mattress 102 may be any known type, including symmetrical and asymmetrical mattresses. If the mattress is of a symmetrical type, the choice of which of the four corners are head corners 110 and which are foot corners 112 may be arbitrary. Similarly, the choice of which side is the top side 104 and which is the bottom side 106 may also be arbitrary. The mattress 102 may be designed to be flipped and/or rotated periodically to provide even wear. In alternative embodiments, the mattress 102 may be a pillow-top or other asymmetrical mattress. Thus, the top side 104 may always remain on top. Alternatively or additionally, the head corners 110 may always remain at the head of the bed, and the foot corners 112 may always remain at the foot of the bed.

As shown, the bedding system 100 may include a number of components. These may include a bottom sheet 120, a top sheet 122, a duvet 124, and/or a pillow 126 (not shown in FIG. 1). The bedding system 100 may have an installed configuration, in which the bottom sheet 120, the top sheet 122, the duvet 124, and/or the pillow 126 are all in place on the mattress 102 to make the bed ready for use, and an uninstalled configuration in which the bottom sheet 120, the top sheet 122, the duvet 124, and/or the pillow 126 are removed from the mattress 102. In the uninstalled configuration, these components may be folded or otherwise compacted for storage. In certain embodiments of the present invention, elastic corners are not required for the bottom sheet 120. Accordingly, in these embodiments, the bottom sheet 120 may be folded in a flat configuration for easier storage.

In the installed configuration, the bottom sheet 120 may be installed on the mattress 102 to cover the mattress 102, or more specifically, the top side 104 and the periphery 108 of the mattress 102. The top sheet 122 may be installed on the bottom sheet 120 so that the user can lie between the bottom sheet 120 and the top sheet 122. The duvet 124 may be installed on the top sheet 122 to provide additional insulation. The pillow 126 may be placed on the top sheet 122 to cushion the head. Installation of the various components of the bedding system 100 on the mattress 102 may optionally proceed in the order set forth above. FIGS. 2-12 illustrate, in further detail, how these components may be configured, and how they may be assembled and/or installed on the mattress 102.

FIG. 1 includes various components and features identified by reference numerals that are not discussed above. These components and features will be discussed below.

Figure 2:
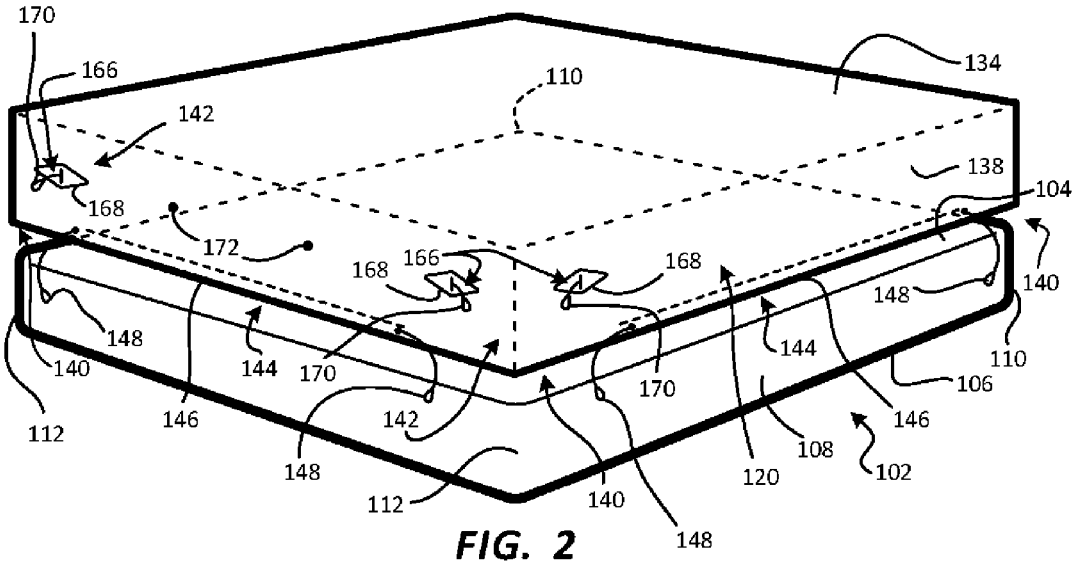
FIG. 2 is a perspective view illustrating installation of the bottom sheet of the bedding system of FIG. 1 on a mattress.

FIG. 2 is a perspective view illustrating installation of the bottom sheet 120 of the bedding system 100 of FIG. 1 on the mattress 102. Configuration and installation of the bottom sheet 120 will now be described with reference to FIGS. 1 and 2.

As shown, the bottom sheet 120 may have a bottom sheet central portion 134 and a bottom sheet peripheral portion 138. The bottom sheet peripheral portion 138 may extend outward from the bottom sheet central portion 134. In the installed configuration, the bottom sheet central portion 134 may cover the top side 104 of the mattress 102, and the bottom sheet peripheral portion 138 may cover the periphery 108 of the mattress 102. The bottom sheet peripheral portion 138 may be sewn such that, in combination with the bottom sheet central portion 134, the bottom sheet peripheral portion 138 defines a box-like configuration with corners that are pre-formed at the proper spacing to align with the corners of the mattress 102. Thus, in the installed configuration, the bottom sheet 120 may fit snugly and securely on the mattress 102.

Advantageously, the bottom sheet 120 may cover the mattress 102 without using any elements that would exert elastic force tending to bunch the bottom sheet peripheral portion 138. Conventional fitted sheets may use elastic elements at the corners; such elastic elements may bunch the corners when the fitted sheets are not in use, making them difficult to fold and store. Further, maintaining the bottom sheet 120 in the installed configuration independently of such elastic elements may help the bottom sheet 120 to remain more securely on the mattress 102.

In place of such elastic elements, the bottom sheet peripheral portion 138 of the bottom sheet 120 may have a plurality of bottom sheet mounting elements 140 that may be used to secure the bottom sheet 120 to the mattress 102. The bottom sheet mounting elements 140 may include four bottom sheet mounting elements 140, one for each corner of the mattress 102. Each of the bottom sheet mounting elements 140 may include multiple parts that facilitate installation of and/or retention of the bottom sheet 120 on the mattress 102.

Further, the bottom sheet peripheral portion 138 of the bottom sheet 120 may have a plurality of bottom sheet fastening elements 142 that may be used to secure the top sheet 122 to the bottom sheet 120. The bottom sheet fastening elements 142 may include two bottom sheet fastening elements 142, one for each of the foot corners 112 of the mattress 102. Each of the bottom sheet fastening elements 142 may include multiple parts that facilitate installation of and/or retention of the top sheet 122 on the bottom sheet 120.

The bottom sheet peripheral portion 138 of the bottom sheet 120 may also have four flexible connectors 144 distributed about the edges of the bottom sheet peripheral portion 138. The flexible connectors 144 may be positioned along a portion of the bottom sheet peripheral portion 138 such that, when the bottom sheet 120 is installed on the mattress 102, each flexible connector 144 is positioned between two adjacent corners of the mattress 102. Each flexible connector 144 may be retained in place on the bottom sheet peripheral portion 138 by, for example, a rolled edge 146 of the bottom sheet peripheral portion 138, which may be wrapped around the flexible connector 144 and secured to itself (for example, via sewing, fastening, or other mechanisms) to keep the flexible connector 144 in place on the bottom sheet peripheral portion 138.

Each flexible connector 144 may have two ends that protrude from the rolled edge 146. The two ends may optionally take the form of loops 148, as shown. Each of the bottom sheet mounting elements 140 may include the loops 148 of the two flexible connectors 144 that are adjacent to it. Each of the bottom sheet mounting elements 140 may be secured to the corresponding corner of the mattress 102 (i.e., to the corresponding one of the head corners 110 or the foot corners 112) by coupling its loops 148 together underneath the corner. This is further illustrated in FIGS. 3A-3C.

In alternative embodiments (not shown), the flexible connectors 144 may be replaced with rigid elements such as dowels, plastic or metal rods, or the like. Such rigid elements may have looped ends similar to the loops 148 illustrated in FIG. 2. Such loops may be formed in the ends of the rigid elements, and may thus be fixedly secured relative to the rigid elements. Alternatively, the loops may be coupled to the rigid elements with hinges or other joints that permit relative motion. In other alternative embodiments, the flexible connectors 144 may be replaced with elements that have some elasticity, but are not as flexible as cords or ropes. Such elements may enable some limited flexure of the edges of the bottom sheet.

Figure 3A:
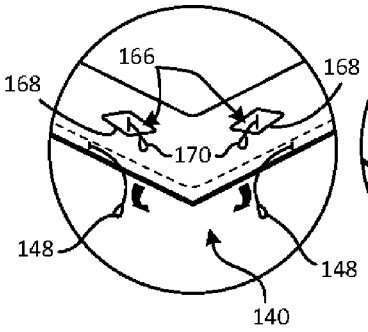
FIGS. 3A-3C are perspective views illustrating one corner of the mattress and bottom sheet of FIG. 2, with a bottom sheet mounting element used to secure the bottom sheet to the corner.
Figure 3B:
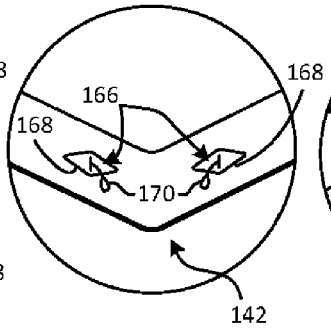
Figure 3C:
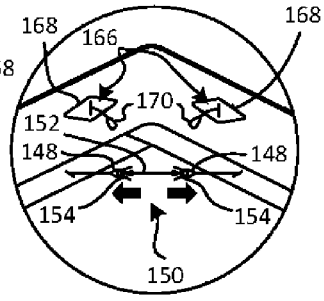

FIGS. 3A-3C are perspective views illustrating one corner of the mattress 102 and the bottom sheet 120 of FIG. 2, with a bottom sheet mounting element 140 used to secure the bottom sheet 120 to the corner. More specifically, in FIG. 3A, the loops 148 of the flexible connectors 144 adjacent to the bottom sheet mounting element 140 may be drawn underneath the corner. This may cause the outer edges of the bottom sheet peripheral portion 138, and more specifically, the rolled edges 146 of the bottom sheet peripheral portion 138, to fold under the mattress 102 to lie adjacent to the bottom side 106 of the mattress 102.

Thus, in FIG. 3B, the rolled edges 146 of the bottom sheet peripheral portion 138 are folded underneath the mattress 102. The loops 148 of the flexible connectors 144 are also underneath the mattress 102 and are prepared to be coupled to each other to keep the bottom sheet 120 in place on the mattress 102. This may be done, for example, through the use of a coupling 150, which is shown in FIG. 3C.

As shown, the coupling 150 may have a linking member 152 with ends connected to two anchors 154. The anchors 154 may be easily coupled to the loops 148. The linking member 152 may exert tension tending to draw the anchors 154 together. This tension may similarly draw the loops 148 of the bottom sheet mounting element 140 together, thereby keeping the corner of the bottom sheet 120 in place on the corresponding corner of the mattress 102. This tension may also result in the application of tension to the flexible connectors 144 adjacent to the bottom sheet mounting element 140. When all four of the bottom sheet mounting element 140 have been secured to the corresponding corners of the mattress 102 in this manner, all of the flexible connectors 144 may be tensioned in a manner that keeps all corners and edges of the bottom sheet peripheral portion 138 of the bottom sheet 120 in place against the bottom side 106 of the mattress 102.

The coupling 150 may be used to perform a variety of attachment functions in conjunction with installation of the bedding system 100 on the mattress 102. The coupling 150 will be further shown and described in connection with FIG. 4.

Figure 4:
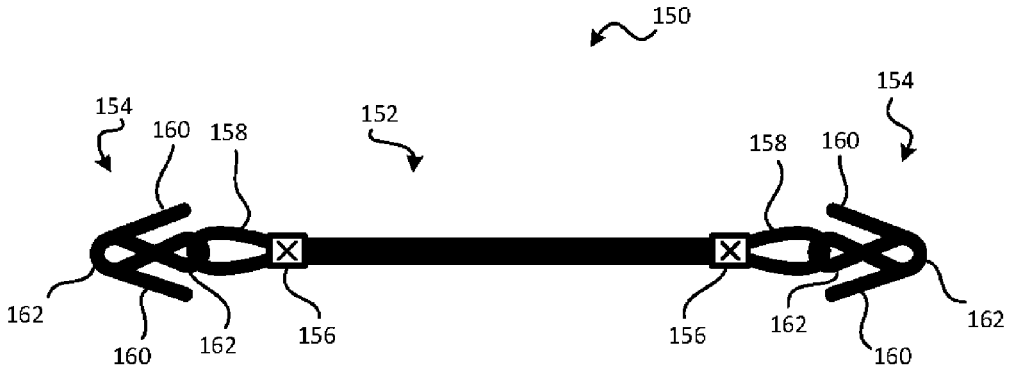
FIG. 4 is a plan view illustrating a coupling of the bedding system of FIG. 1.

FIG. 4 is a plan view illustrating a coupling 150 of the bedding system 100 of FIG. 1. The linking member 152 and the anchors 154 of the coupling 150 were mentioned previously. The linking member 152 may have a flexible component, such as a length of relatively inelastic rubber or plastic material, which may be formed as a loop or made into a loop by securing its ends together. The opposing sides of the flexible component may be secured together through the use of clips 156. The clips 156 may be secured at offsets from the opposite ends of the linking member 152 (for example, by stamping, swaging, and/or other compression techniques) to define loops 158 of the linking member 152. The loops 158 may be secured to the anchors 154.

In some embodiments, the linking member 152 may also be elastic so that the linking member 152 applies elastic force tending to draw the anchors 154 together. In such embodiments, the linking member 152 may have a flexible elastic component, such as the elastic component of a bungee cord or shock cord.

Each of the anchors 154 may optionally be formed from a metal piece, such as a rod or strip, which has been folded, curled, and/or otherwise bent into a desired shape. The shape may define a pair of arms 160 and a looped portion 162. The arms 160 may extend from the looped portion 162 in a manner that facilitates attachment of the anchor 154 to the loop 148 of the flexible connector 144 to which it is to be secured. More specifically, the arms 160 may be inserted through the loop 148 without inserting the looped portion 162 of the anchor 154 through the loop 148. Thus, the arms 160 and the loop 148 may effectively interlock.

The looped portion 162 may be secured to the loop 158 of the linking member 152 that is adjacent to it via passage of the looped portion 162 through the loop 158. This may be done prior to formation of the loop 158 in the linking member 152. Alternatively, the looped portion 162 may be made such that the looped portion 162 can be interlocked with the loop 158 after the loop 158 has been formed. For example, the looped portion 162 may define a three-dimensional figure eight pattern or the like. One of the arms 160 may be inserted through the loop 158 and the anchor 154 may be rotated in such a manner that the loop 158 slides along the figure eight pattern until the loop 158 interlocks with the looped portion 162 in the manner shown in FIG. 4.

In alternative embodiments (not shown), a looped portion of an anchor may have a simple toggle mechanism. For example, such a looped portion may pivot between an open configuration, in which the looped portion can be inserted into engagement with the loop 158 in the linking member 152, and a closed configuration, in which the looped portion is interlocked with the loop 158. The looped portion may thus remain coupled to the loop 158 until the user takes action to move the looped portion back to the open configuration to release the loop 158.

Returning to the embodiment of FIG. 4, the coupling 150 may have a length that is essentially non-adjustable. In alternative embodiments of the invention, couplings may have adjustable lengths to facilitate their use with different components of the bedding system 100 and/or bedding systems of different sizes (for example, bedding systems for twin, double, full, queen, king, California king, or other known mattress sizes).

Figure 5:
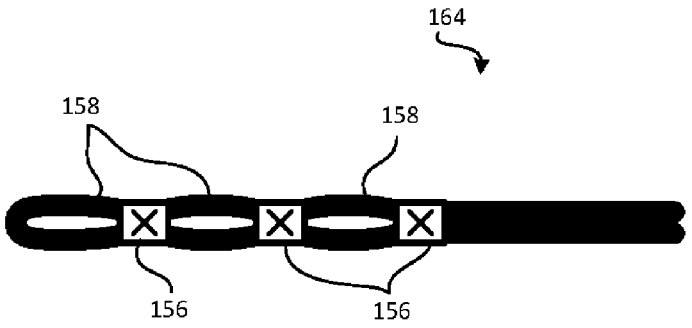
FIG. 5 is a plan view illustrating a portion of a coupling according to one alternative embodiment.

FIG. 5 is a plan view illustrating the linking member 164 of a coupling according to one alternative embodiment. The linking member 164 may be used with anchors 154 like those of the coupling 150 of FIG. 4. However, the linking member 164 may have multiple (for example, three) loops 158 on each end. The loops 158 may be formed by securing multiple clips 156 to the flexible component at the desired spacing to define the loops 158.

In use, each of the anchors 154 may be secured to the desired loop 158 on the corresponding end of the linking member 164. Thus, the anchors 154 may be secured to the loops 158 at the terminal ends of the linking member 164 to define a longer coupling, secured to the loops 158 just interior to the loops 158 at the terminal ends of the linking member 164 to define a medium-length coupling, and/or secured to the loops 158 proximate the center of the linking member 164 to define a shorter coupling. More or fewer than three loops may be present on each end of the linking member 164. The anchors 154 may be removed from one loop 158 and coupled to another 158, for example by the user, in order to adjust the length of the coupling defined by the linking member 164 and the anchors 154. This, in turn, may adjust the amount of tension applied, with longer couplings generally applying less tension than shorter couplings.

Returning to FIG. 3C, the bottom sheet 120 may be in the installed configuration when the coupling 150 of each bottom sheet mounting element 140 has been secured to the ends of the flexible connectors 144 adjacent to it in the manner shown in FIG. 3C. The bottom sheet 120 may thus be retained securely on the mattress 102 without the need for elements that, in the installed configuration, exert elastic force tending to bunch the bottom sheet peripheral portion 138 of the bottom sheet 120.

The bottom sheet mounting elements 140 represent only one of many mounting element types that may be used to secure a bottom sheet to a mattress within the scope of the present disclosure. In alternative embodiments, a wide variety of mounting elements may be used, including but not limited to other types of fastening devices such as buttons, snaps, clips, clasps, ties, hook and loop fasteners, and the like. Such mounting elements may include the use of couplings, which need not necessarily be configured like the couplings 150 of FIG. 4. Rather, such couplings may or may not provide elastic force, and may have any type of anchoring features, including but not limited to buttons, snaps, clips, clasps, ties, hook and loop fasteners, and the like.

Returning to FIG. 2, the bottom sheet fastening elements 142 may be used to secure the top sheet 122 to the bottom sheet 120, as mentioned previously. The top sheet 122 may advantageously be secured to the bottom sheet 120 only proximate the foot corners 112 of the mattress 102. This may help to keep the top sheet 122 in place on the bottom sheet 120 without unnecessarily inhibiting motion of the user between the bottom sheet 120 and the top sheet 122. Hence, the bottom sheet 120 may include two bottom sheet fastening elements 142, each of which is located on the bottom sheet peripheral portion 138, proximate one of the foot corners 112 of the mattress 102 when the bottom sheet 120 is in the installed configuration on the mattress 102.

Each bottom sheet fastening element 142 may include multiple components. As embodied in FIG. 2, each bottom sheet fastening element 142 may have two flexible connectors 166, each of which has a proximal end anchored to the bottom sheet 120. The proximal end of each flexible connector 166 may optionally be secured to a reinforcement patch 168, which may be secured to the bottom sheet peripheral portion 138 of the bottom sheet 120. Each reinforcement patch 168 may help to spread tension exerted by the flexible connector 166 over a relatively large area of the bottom sheet peripheral portion 138, thereby providing more secure anchorage of the flexible connectors 166 on the bottom sheet peripheral portion 138.

Each flexible connector 166 may have, at its distal end, a loop 170. The loops 170 of each bottom sheet fastening element 142 may be secured together to keep the top sheet 122 in place on the bottom sheet 120 in a manner that will be shown and described subsequently.

If desired, the bottom sheet 120 may further have supplemental fastening elements that further secure the top sheet 122 to the bottom sheet 120 (i.e., in addition to the securement provided by the bottom sheet fastening elements 142). As embodied in FIG. 2, such supplemental fastening elements may take the form of buttons 172. The buttons may be secured to the bottom sheet peripheral portion 138 of the bottom sheet 120 such that, with the bottom sheet 120 in the installed configuration on the mattress, the buttons 172 are positioned between the foot corners 112 of the mattress 102. The buttons 172 may help to keep the top sheet 122 in place on the bottom sheet 120 in a manner that will be shown and described subsequently.

Figure 6:
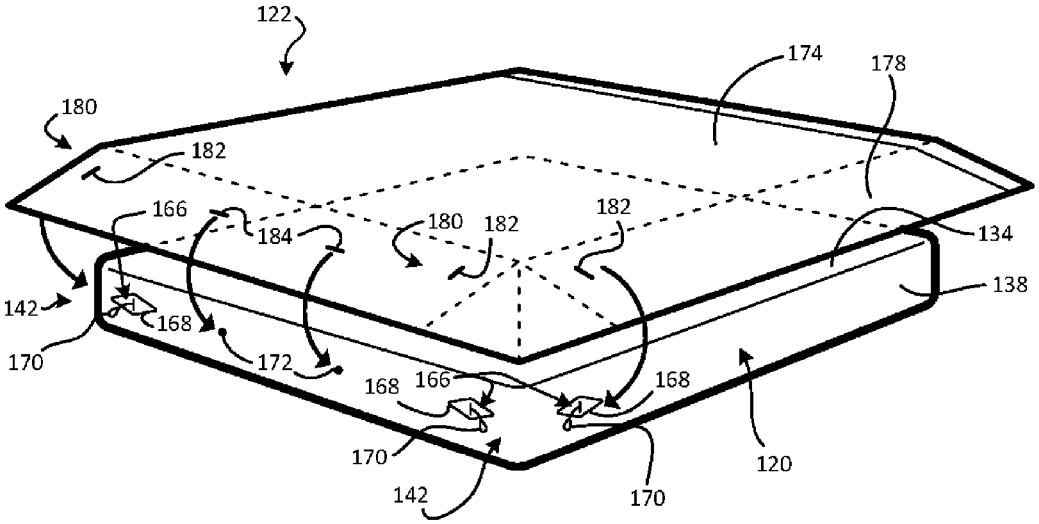
FIG. 6 is a perspective view illustrating installation of the top sheet onto the bottom sheet of the bedding system of FIG. 1.

FIG. 6 is a perspective view illustrating installation of the top sheet 122 onto the bottom sheet 120 of the bedding system 100 of FIG. 1. As shown, the bottom sheet 120 is already in the installed configuration on the mattress 102, which may be accomplished by following the procedures set forth previously.

As shown, the top sheet 122 may have a top sheet central portion 174 and a top sheet peripheral portion 178. The top sheet peripheral portion 178 may extend outward from the top sheet central portion 174. In the installed configuration, the top sheet central portion 174 may cover the bottom sheet central portion 134 of the bottom sheet 120, and the top sheet peripheral portion 178 may cover the bottom sheet peripheral portion 138 of the bottom sheet 120. Unlike the bottom sheet 120, the top sheet 122 may have a generally flat construction. Accordingly, when the top sheet 122 is in place on the bottom sheet 120, the portions of the top sheet peripheral portion 178 that overlie the foot corners 112 of the mattress 102 may be pleated and/or folded such that the corresponding corners of the top sheet 122 are folded behind the remainder of the top sheet peripheral portion 178.

The top sheet peripheral portion 178 of the top sheet 122 may have a plurality of top sheet mounting elements 180 that may be used to secure the top sheet 122 to the bottom sheet 120, or more specifically, to the bottom sheet fastening element 142 of the bottom sheet 120. The top sheet mounting element 180 may include two top sheet mounting elements 180, one for each foot corner 112 of the mattress 102. Each of the top sheet mounting elements 180 may include multiple parts that facilitate installation of and/or retention of the top sheet 122 on the bottom sheet 120.

More specifically, each top sheet mounting element 180 may include two slots 182. When the top sheet 122 is properly aligned with the bottom sheet 120, each slot 182 may be aligned with one of the flexible connectors 166 of the bottom sheet fastening elements 142 of the bottom sheet 120. Thus, the loop 170 of one of the flexible connectors 166 may be inserted through each of the slots 182 of the top sheet mounting elements 180.

Further, the top sheet 122 may have a plurality of supplemental mounting elements that can be secured to the supplemental fastening elements of the bottom sheet 120 to further keep the top sheet 122 in place on the bottom sheet 120. The supplemental mounting elements may, for example, take the form of supplemental slots 184. When the top sheet 122 is properly aligned with the bottom sheet 120, each of the supplemental slots 184 may align with one of the supplemental fastening elements of the bottom sheet 120, i.e., one of the buttons 172. Each of the buttons 172 may be inserted through one of the supplemental slots 184 to further keep the top sheet 122 in place on the bottom sheet 120.

Figure 7:
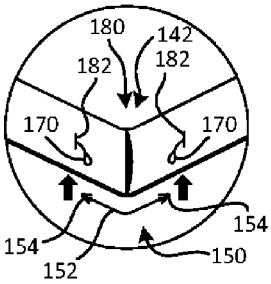
FIG. 7 is a perspective view illustrating one corner of the mattress, bottom sheet, and top sheet of FIG. 6, with the loops of one bottom sheet fastening element inserted through the slots of one top sheet mounting element.

FIG. 7 is a perspective view illustrating one corner of the mattress 102, the bottom sheet 120, and the top sheet 122 of FIG. 6, with the bottom sheet 120 secured to the mattress 102 and the top sheet 122 placed on and aligned with the bottom sheet 120. The loops 170 of one bottom sheet fastening element 142 have been inserted through the slots 182 of one top sheet mounting element 180. Securing the loops 170 of the bottom sheet fastening element 142 together may prevent withdrawal of the loops 170 through the slots 182, thereby keeping the top sheet 122 in place on the bottom sheet 120. If desired, the loops 170 may be secured together through the use of a coupling, such as the coupling 150 of FIG. 4.

Figure 8:
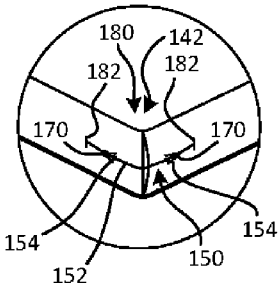
FIG. 8 is a perspective view illustrating one corner of the mattress, bottom sheet, and top sheet of FIG. 6, with the coupling used to secure the loops of the bottom sheet fastening element together.

FIG. 8 is a perspective view illustrating one corner of the mattress 102, bottom sheet 120, and top sheet 122 of FIG. 6, with the coupling 150 of FIG. 4 used to secure the loops 170 of the bottom sheet fastening element 142 together. This may be accomplished by interlocking the arms 160 of each of the anchors 154 of the coupling 150 with one of the loops 170, as described previously in conjunction with the loops 148 of the bottom sheet mounting elements 140. The linking member 152 may exert force tending to draw the anchors 154 and thence the loops 170 together, thus holding the associated portion of the top sheet peripheral portion 178 securely against the corresponding portion of the bottom sheet peripheral portion 138. Installation of the top sheet 122 may now be complete.

The top sheet mounting element 180 and the bottom sheet fastening element 142 may cooperate to keep the top sheet 122 in place on the bottom sheet 120 during sleep; accordingly, after the user exits the bed, the top sheet 122 may easily be smoothed on the bottom sheet 120 to make the bed. Some users may significantly move the head portion of the top sheet 122 during sleep, but the foot portion of the top sheet 122 may remain in place due to the action of the bottom sheet fastening elements 142 and the top sheet mounting elements 180. Thus, only the head portion of the top sheet 122 may require realignment with the corresponding head portion of the bottom sheet 120.

The top sheet mounting elements 180 represent only one of many mounting element types that may be used to secure a top sheet to a bottom sheet within the scope of the present disclosure. In alternative embodiments, a wide variety of mounting elements may be used, including but not limited to other types of fastening devices such as buttons, snaps, clips, clasps, ties, hook and loop fasteners, and the like. Such mounting elements may include the use of couplings, which need not necessarily be configured like the couplings 150 of FIG. 4. Rather, such couplings may or may not provide elastic force, and may have any type of anchoring features, including but not limited to buttons, snaps, clips, clasps, ties, hook and loop fasteners, and the like. In alternative embodiments, different top sheet mounting elements may be secured to bottom sheet fastening elements that are different from the bottom sheet fastening elements 142.

Figure 9:
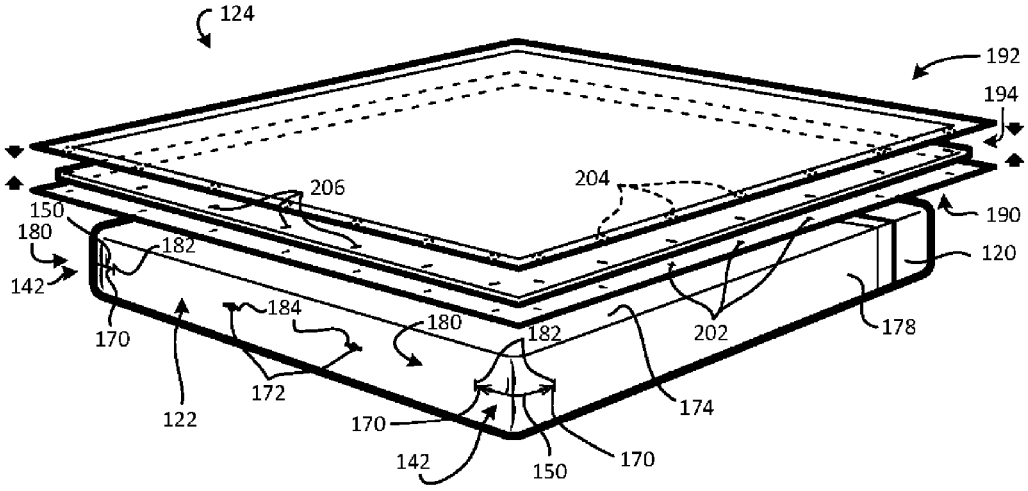
FIG. 9 is a perspective view illustrating assembly of the duvet and installation of the duvet onto the top sheet and bottom sheet of the bedding system of FIG. 1.

FIG. 9 is a perspective view illustrating assembly of the duvet 124 and installation of the duvet 124 onto the top sheet 122 and bottom sheet 120 of the bedding system 100 of FIG. 1. As shown, the duvet 124 may have a bottom cover 190, a top cover 192, and a thermal layer 194. The bottom cover 190 and the top cover 192 may be secured together to capture the thermal layer 194 between them. The duvet 124, as a whole, may also be secured to the remainder of the bedding system 100. This may be accomplished through the use of a plurality of cover mounting elements, which may take the form of straps 200 of the bottom cover 190, one of which will be shown and described in connection with FIG. 10A.

The bottom cover 190 may also have a plurality of bottom cover fastening elements that are designed to facilitate attachment of the bottom cover 190 to the top cover 192. The bottom cover fastening elements may take the form of bottom cover slots 202 distributed about the periphery of the bottom cover 190. Similarly, the top cover 192 may have a plurality of top cover fastening elements that facilitate attachment of the top cover 192 to the bottom cover 190, and more specifically, to the bottom cover fastening elements (i.e., the bottom cover slots 202). The top cover fastening elements may optionally take the form of top cover buttons 204. The top cover buttons 204 may be distributed about the periphery of the top cover 192 in alignment with the bottom cover slots 202. Each of the top cover buttons 204 may be sized to fit through one of the bottom cover slots 202.

Further, the thermal layer 194 may have a plurality of thermal layer fastening elements that can be used to secure the thermal layer 194 to the bottom cover 190 and the top cover 192. The thermal layer fastening elements may optionally take the form of thermal layer slots 206 distributed about the periphery of the thermal layer 194 in alignment with the bottom cover slots 202 and the top cover buttons 204. Each of the thermal layer slots 206 may be sized to receive one of the top cover buttons 204. Thus, each top cover button 204 may be inserted through one of the thermal layer slots 206, and then through one of the bottom cover slots 202.

Optionally, the thermal layer 194 may not be attached to the bottom cover 190 or the top cover 192, but may instead be retained between the bottom cover 190 and the top cover 192 simply by virtue of the attachment of the bottom cover 190 to the top cover 192. However, attaching the thermal layer 194 to the bottom cover 190 and the top cover 192 by virtue of the thermal layer slots 206, as shown in FIG. 9, may help to keep the edges of the thermal layer 194 coextensive with those of the bottom cover 190 and the top cover 192 to prevent bunching or gathering of the thermal layer 194 in the space between the bottom cover 190 and the top cover 192.

Figure 10A:
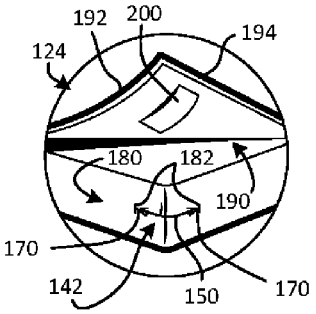
FIGS. 10A and 10B are, respectively, a perspective view illustrating one corner of the mattress, showing securement of the duvet to the top sheet, and a perspective view illustrating an edge of the duvet, showing attachment of the top cover, bottom cover, and thermal layer of the duvet.

FIG. 10A is a perspective view illustrating one corner of the mattress 102, showing securement of the duvet 124 to the top sheet 122. The straps 200 may be secured to the underside of the portions of the bottom cover 190 that will overlie the foot corners 112 of the mattress. Thus, two straps 200 may be secured to the bottom cover 190: one for each of the foot corners 112 and thence, one for secured set of a bottom sheet fastening element 142 and a top sheet mounting element 180. Each of the straps 200 may be used to secure the corresponding corner of the duvet 124 to the top sheet 122 by securing the duvet 124 to the bottom sheet fastening element 142 and the top sheet mounting element 180. In this application, securing the duvet 124 to the top sheet 122 means securing the duvet 124 such that the duvet 124 lies on the top sheet 122. However, the actual attachment of the duvet 124 may be accomplished through the use of elements of the bottom sheet 120 and/or elements of the top sheet 122.

The strap 200 may be a strip of flexible material such as cloth, leather, plastic, or the like, and may be secured at both ends to the underside of the bottom cover 190. Thus, a corner of the duvet 124 may be secured to the top sheet 122 by detaching an anchor 154 of the coupling 150 of the top sheet mounting element 180 from the loop 170 to which it is secured (if the coupling 150 has already been secured to both loops 170 of the top sheet mounting element 180 as in FIG. 10A), routing the coupling 150 between the strap 200 and the adjacent surface of the bottom cover 190, and then securing the anchor 154 to the loop 170. The strap 200 may then be captured between the coupling 150 and the top sheet peripheral portion 178 of the top sheet 122, securing the duvet 124 to the top sheet 122.

The duvet 124 may thus be secured to the top sheet 122 through the use of the bottom sheet fastening elements 142 of the bottom sheet 120 and the top sheet mounting elements 180 of the top sheet 122. Advantageously, the bottom sheet 120 and the top sheet 122 need not have any other fastening or mounting elements, aside from the bottom sheet fastening elements 142 and the top sheet mounting elements 180, to secure the duvet 124 to the top sheet 122.

Securing the duvet 124 to the top sheet 122 may advantageously keep the duvet 124 aligned with the top sheet 122 and the bottom sheet 120. This may facilitate making the bed after sleep. More specifically, due to the securement of the straps 200 to the bottom sheet fastening elements 142 and the top sheet mounting elements 180, the foot portion of the duvet 124 may remain in place as the user moves in his or her sleep. As mentioned above, the foot portion of the top sheet 122 may also remain in place. Thus, making the bed may only require realigning the head portions of the top sheet 122 and the duvet 124 with the corresponding head portion of the bottom sheet 120.

The straps 200 represent only one of many mounting element types that may be used to secure a duvet to a top sheet within the scope of the present disclosure. In alternative embodiments, a wide variety of mounting elements may be used, including but not limited to other types of fastening devices such as buttons, snaps, clips, clasps, ties, hook and loop fasteners, and the like. Such mounting elements may include the use of couplings, which need not necessarily be configured like the couplings 150 of FIG. 4. Rather, such couplings may or may not provide elastic force, and may have any type of anchoring features, including but not limited to buttons, snaps, clips, clasps, ties, hook and loop fasteners, and the like. In alternative embodiments, different duvet mounting elements may be secured to bottom sheet fastening elements and/or top sheet fastening elements that complement the selected duvet mounting elements.

Figure 10B:
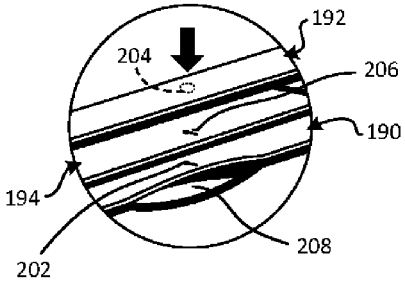

FIG. 10B is a perspective view illustrating an edge of the duvet 124, showing attachment of the bottom cover 190, top cover 192, and thermal layer 194 of the duvet 124 in greater detail. As shown, the bottom cover 190 may have a pocket 208 defined by separation of layers of material of the bottom cover 190. The bottom cover 190 may have a pocket 208 in alignment with each of the bottom cover slots 202. Each pocket 208 may define a space within which one of the top cover buttons 204 may reside after insertion of the top cover button 204 through the thermal layer slot 206 and the bottom cover slot 202. Thus, the top cover buttons 204 may be effectively covered, thus reducing the risk of snagging on other articles or causing discomfort to the user.

The bottom cover slots 202, top cover buttons 204, and thermal layer slots 206 represent only one of many fastening element types that may be used to secure a top cover to a bottom cover and/or a thermal layer of a duvet within the scope of the present disclosure. In alternative embodiments, a wide variety of fastening elements may be used, including but not limited to other types of fastening devices such as buttons, snaps, clips, clasps, ties, hook and loop fasteners, and the like.

Figure 11:
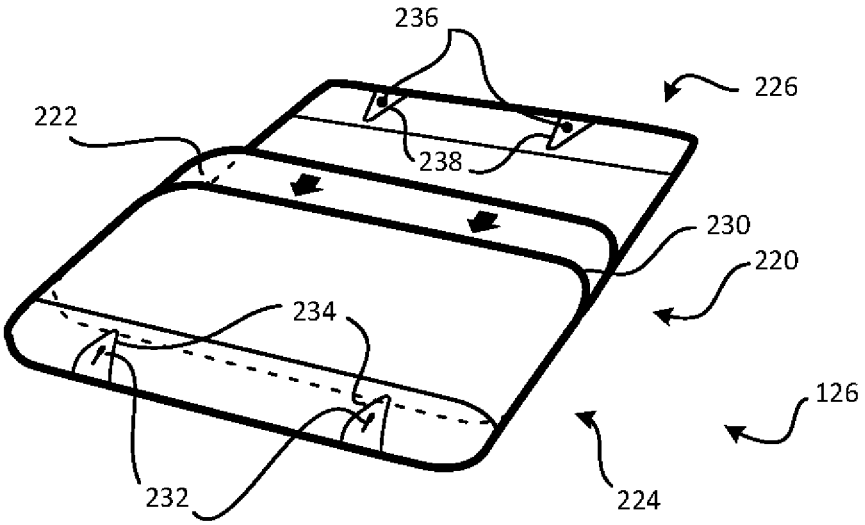
FIG. 11 is a perspective view illustrating insertion of a cushion into an envelope to provide a pillow that may be used in conjunction with the bedding system of FIG. 1.

FIG. 11 is a perspective view illustrating insertion of a cushion 222 into an envelope 220 to provide the pillow 126, which may be used in conjunction with the bedding system 100 of FIG. 1. As shown, the envelope 220 may be sized to receive the cushion 222 and generally enclose the cushion 222. The envelope 220 may have a sleeve 224 that receives the cushion 222 and a flap 226 that can be folded over the sleeve 224 to capture the cushion 222 within the sleeve 224. As shown, the sleeve 224 may be shaped to define a pocket 230 sized and shaped to receive the cushion 222. The envelope 220 may have an open configuration (shown in FIG. 11) in which the cushion 222 can be inserted into the sleeve 224, and a closed configuration (shown in FIG. 12) in which the flap 226 is folded against the sleeve 224 to capture the cushion 222 within the pocket 230.

The sleeve 224 may have a plurality of sleeve fastening elements that can be used to secure the sleeve 224 to the flap 226, thereby keeping the envelope 220 in the closed configuration. As embodied in FIG. 11, the sleeve fastening elements may take the form of slots 232. The slots 232 may be formed in reinforcement patches 234 secured to the exterior surface of the sleeve 224. The reinforcement patches 234 may be attached at their edges to the sleeve 224 to define cavities between the reinforcement patches 234 and the sleeve 224.

Similarly, the flap 226 may have a plurality of flap fastening elements that can be used to secure the flap 226 to the sleeve 224, or more specifically, to the slots 232 of the sleeve 224. As embodied in FIG. 11, the flap fastening elements may take the form of buttons 236. The buttons 236 may be spaced apart such that they align with the slots 232 when the envelope 220 is in the closed configuration. Further, each button 236 may be sized to fit into one of the slots 232 to retain the envelope 220 in the closed configuration. The buttons 236 may be anchored to the flap 226 via reinforcement patches 238. Each reinforcement patch 238 may help to spread tension exerted by the button 236 over a relatively large area of the flap 226, thereby providing more secure anchorage of the buttons 236 on the flap 226.

Figure 12:
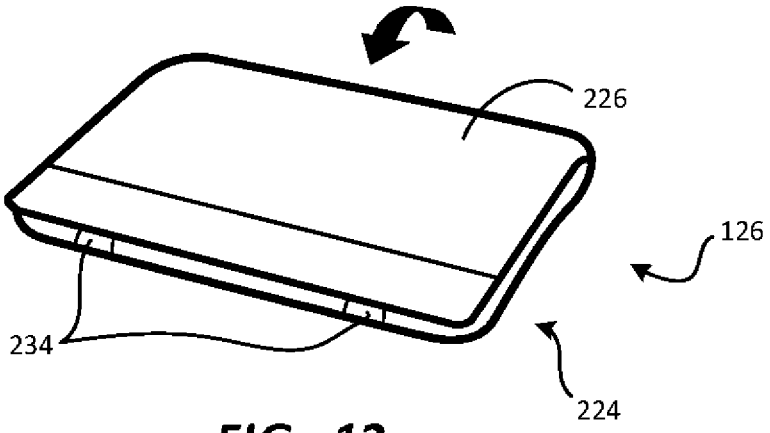
FIG. 12 is a perspective view illustrating the pillow of FIG. 11, with a flap of the envelope secured to a sleeve of the envelope to secure the cushion within the sleeve.

FIG. 12 is a perspective view illustrating the pillow of FIG. 11, with the flap 226 of the envelope 220 secured to the sleeve 224 of the envelope 220 to secure the cushion 222 within the sleeve 224. The buttons 236 may be inserted through the slots 232 and retained therein by the geometry of the slots 232, thereby preventing the envelope 220 from moving back to the open configuration until the user disengages the buttons 236 from the slots 232. The envelope 220 may thus protect the cushion 222 and may serve as a decorative feature that matches and/or complements the other components of the bedding system 100, such as the bottom sheet 120, the top sheet 122, and the duvet 124.

The slots 232 and buttons 236 represent only one of many fastening element types that may be used to secure a flap to a sleeve within the scope of the present disclosure. In alternative embodiments, a wide variety of fastening elements may be used, including but not limited to other types of fastening devices such as buttons, snaps, clips, clasps, ties, hook and loop fasteners, and the like.

It is understood that any specific order or hierarchy of steps in any disclosed process is an example of a sample approach. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the scope of the disclosure. Thus, the present disclosure is not intended to be limited to the aspects shown herein but is to be accorded the widest scope consistent with the principles and novel features disclosed.

What is claimed is:

1. A bedding system comprising an uninstalled configuration and an installed configuration relative to a mattress comprising a top side, a bottom side, and a periphery, the bedding system comprising:

a bottom sheet comprising:

a bottom sheet central portion; and a bottom sheet peripheral portion extending from the bottom sheet central portion, the bottom sheet peripheral portion comprising:

a plurality of bottom sheet mounting elements; and a plurality of bottom sheet fastening elements;

a top sheet comprising:

a top sheet central portion; and a top sheet peripheral portion extending from the top sheet central portion, the top sheet peripheral portion comprising a plurality of top sheet mounting elements; and a duvet comprising:

a thermal layer;

a bottom cover comprising:

a plurality of bottom cover mounting elements; and a plurality of bottom cover fastening elements; and a top cover comprising a plurality of top cover fastening elements, each of which is securable to one of the bottom cover fastening elements to capture the thermal layer between the bottom cover and the top cover;

wherein, in the installed configuration, the bottom sheet central portion covers the top side of the mattress, the bottom sheet peripheral portion covers the periphery of the mattress, the bottom sheet mounting elements secure the bottom sheet to the mattress, each of the top sheet mounting elements is secured to one of the bottom sheet fastening elements to secure the top sheet peripheral portion to the bottom sheet peripheral portion, and the bottom cover mounting elements are secured to the top sheet;

wherein, in the uninstalled configuration, the bottom sheet is not secured to the mattress, the top sheet is not secured to the bottom sheet, and the bottom cover is not secured to the top sheet;

wherein the mattress comprises four corners, wherein the plurality of bottom sheet mounting elements comprises four bottom sheet mounting elements, wherein the bottom sheet peripheral portion comprises four flexible connectors, each of which is coupled to one edge of the bottom sheet peripheral portion, wherein each of the flexible connectors comprises two ends, each of which comprises a loop, wherein each of the bottom sheet mounting elements comprises a first coupling that, in the installed configuration, extends underneath a corresponding corner of the four corners to attach the loops of a corresponding two adjacent ends of the ends of the flexible connectors together;

wherein the four corners comprise two foot corners, wherein the plurality of bottom sheet fastening elements comprises two bottom sheet fastening elements, each of which comprises a second coupling, a fifth flexible connector, and a sixth flexible connector, wherein each of the fifth flexible connectors and each of the sixth flexible connectors comprise a loop; and wherein the plurality of top sheet mounting elements comprises two top sheet mounting elements, each of which comprises a first slot and a second slot; and wherein, in the installed configuration, each of the two bottom sheet fastening elements is positioned proximate one of the two foot corners, each of the two top sheet mounting elements is positioned proximate one of the two foot corners, the loop of each fifth flexible connector is inserted through a corresponding first slot of the first slots, the loop of each sixth flexible connector is inserted through a corresponding second slot of the second slots, and each second coupling is attached to the loops of a corresponding fifth and sixth flexible connectors of the fifth and sixth flexible connectors.

2. A bedding system comprising an uninstalled configuration and an installed configuration relative to a mattress comprising a top side, a bottom side, and a periphery, the bedding system comprising:

a bottom sheet comprising:

a bottom sheet central portion; and a bottom sheet peripheral portion extending from the bottom sheet central portion, the bottom sheet peripheral portion comprising:

a plurality of bottom sheet mounting elements; and a plurality of bottom sheet fastening elements; and a top sheet comprising:

a top sheet central portion; and a top sheet peripheral portion extending from the top sheet central portion, the top sheet peripheral portion comprising a plurality of top sheet mounting elements;

wherein, in the installed configuration, the bottom sheet central portion covers the top side of the mattress, the bottom sheet peripheral portion covers the periphery of the mattress, the bottom sheet mounting elements secure the bottom sheet to the mattress, and each of the top sheet mounting elements is secured to one of the bottom sheet fastening elements to secure the top sheet peripheral portion to the bottom sheet peripheral portion;

wherein, in the uninstalled configuration, the bottom sheet is not secured to the mattress, the top sheet is not secured to the bottom sheet, and the bottom sheet mounting elements do not exert elastic force tending to bunch the bottom sheet peripheral portion;

wherein the mattress comprises four corners, wherein the plurality of bottom sheet mounting elements comprises four bottom sheet mounting elements, wherein, in the installed configuration, each of the bottom sheet mounting elements extends underneath one of the corners to secure the bottom sheet to the mattress;

wherein the bottom sheet peripheral portion comprises four flexible connectors, each of which is coupled to one edge of the bottom sheet peripheral portion, wherein each of the flexible connectors comprises two ends, wherein each of the bottom sheet mounting elements comprises two adjacent ends of the flexible connectors; and wherein each of the bottom sheet mounting elements further comprises a coupling that, in the installed configuration, extends underneath a corresponding corner of the four corners to attach a corresponding two adjacent ends of the flexible connectors together;

wherein each of the ends of the flexible connectors comprises a loop, wherein each of the couplings comprises:

two anchors, each of which is securable to a corresponding one of the loops of the flexible connectors, at least one of the anchors comprising a first arm and a second arm, the first arm being disposed at an acute angle with respect to the second arm; and a linking member secured to the anchors to apply tension tending to draw the two anchors together.

3. The bedding system of claim 2, wherein the four corners of the mattress comprise two foot corners, wherein the plurality of bottom sheet fastening elements comprises two bottom sheet fastening elements and the plurality of top sheet mounting elements comprises two top sheet mounting elements, wherein, in the installed configuration, each of the two bottom sheet fastening elements is positioned proximate one of the two foot corners and each of the two top sheet mounting elements is positioned proximate one of the two foot corners.

4. The bedding system of claim 3, wherein each of the top sheet mounting elements comprises a first slot that, in the installed configuration, receives a corresponding bottom sheet fastening element of the plurality of bottom sheet fastening elements to secure the top sheet mounting element to the bottom sheet fastening element.

5. The bedding system of claim 4, wherein each of the top sheet mounting elements further comprises a second slot, wherein each of the bottom sheet fastening elements comprises a first flexible connector insertable through a corresponding first slot of the first slots and a second flexible connector insertable through a corresponding second slot of the second slots, wherein, in the installed configuration, the first and second flexible connectors of each of the bottom sheet fastening elements are attached to each other.

6. The bedding system of claim 2, further comprising:

a duvet comprising:

a thermal layer;

a bottom cover comprising:

a plurality of bottom cover mounting elements; and a plurality of bottom cover fastening elements; and a top cover comprising a plurality of top cover fastening elements, each of which is securable to one of the bottom cover fastening elements to capture the thermal layer between the bottom cover and the top cover;

wherein, in the installed configuration, the bottom cover mounting elements are secured to the top sheet, and in the uninstalled configuration, the bottom cover mounting elements are not secured to the top sheet.

7. The bedding system of claim 6, further comprising:

a pillow comprising:

a cushion; and an envelope comprising:

a sleeve that defines a pocket shaped to receive the cushion, the sleeve comprising a plurality of sleeve fastening elements; and a flap extending from the sleeve, the flap comprising a plurality of flap fastening elements, each of which is securable to one of the sleeve fastening elements to capture the cushion within the pocket.

8. A method for installing the bedding system of claim 1 on the mattress, the method comprising:

positioning the bottom sheet on the mattress;

positioning the bottom sheet such that the bottom sheet central portion covers the top side of the mattress and the bottom sheet peripheral portion covers the periphery of the mattress;

securing the bottom sheet to the mattress with the bottom sheet mounting elements to secure the bottom sheet peripheral portion to the periphery;

positioning the top sheet on the bottom sheet;

positioning the top sheet such that the top sheet central portion covers the bottom sheet central portion; and securing each of the top sheet mounting elements to one of the bottom sheet fastening elements to secure the top sheet peripheral portion to the bottom sheet peripheral portion.

9. The method of claim 8, wherein securing the bottom sheet to the mattress comprises:

positioning each coupling to extend underneath one of the corners; and attaching the corresponding two adjacent ends of the flexible connectors together with the coupling.

10. The method of claim 9, wherein each of the couplings comprises two anchors and a linking member secured to the anchors, wherein attaching the corresponding two adjacent ends of the flexible connectors together with the coupling comprises securing each of the anchors to one of the loops of the flexible connectors, wherein securing the bottom sheet to the mattress further comprises, with the linking member, applying tension tending to draw the two anchors together.

11. The method of claim 8, wherein positioning the top sheet such that the top sheet central portion covers the bottom sheet central portion comprises:

positioning each of the two bottom sheet fastening elements proximate one of the two foot corners; and positioning each of the two top sheet mounting elements proximate one of the two foot corners;

wherein securing each of the top sheet mounting elements to one of the bottom sheet fastening elements comprises:

inserting the loop of a particular one of the fifth flexible connectors through one of the first slots;

inserting the loop of a particular one of the sixth flexible connectors through one of the second slots; and attaching the loop of the particular one of the fifth flexible connectors to the loop of the particular one of the sixth flexible connectors.

12. The method of claim 11, wherein attaching the loop of the particular one of the fifth flexible connectors to the loop of the particular one of the sixth flexible connectors comprises:

securing a first anchor of the second coupling to the loop of the particular one of the fifth flexible connectors and a second anchor of the second coupling to the loop of the particular one of the sixth connectors; and with a linking member secured to each of the first anchor and each second anchor, applying tension tending to draw the first and second anchors together.

13. The method of claim 8, further comprising:

securing a duvet to the top sheet, the duvet comprising a thermal layer, a bottom cover comprising a plurality of bottom cover mounting elements, and a top cover securable to the bottom cover to capture the thermal layer between the bottom cover and the top cover;

wherein securing the duvet to the top sheet comprises securing the bottom cover mounting elements to the top sheet.

* * * * *